US009934738B2

(12) United States Patent
Zhang

(10) Patent No.: US 9,934,738 B2
(45) Date of Patent: Apr. 3, 2018

(54) PANEL SIGNAL CONTROL CIRCUIT, DISPLAY PANEL AND DISPLAY DEVICE

(71) Applicant: Shenzhen China Star Optoelectronics Technology Co., Ltd., Shenzhen, Guangdong (CN)

(72) Inventor: Hua Zhang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 219 days.

(21) Appl. No.: 14/905,077

(22) PCT Filed: Oct. 23, 2015

(86) PCT No.: PCT/CN2015/092764
§ 371 (c)(1),
(2) Date: Jan. 14, 2016

(87) PCT Pub. No.: WO2017/054270
PCT Pub. Date: Apr. 6, 2017

(65) Prior Publication Data

US 2017/0256213 A1 Sep. 7, 2017

(30) Foreign Application Priority Data

Sep. 30, 2015 (CN) ..... 2015 1 0638626

(51) Int. Cl.
*G09G 3/36* (2006.01)

(52) U.S. Cl.
CPC ... *G09G 3/3648* (2013.01); *G09G 2300/0408* (2013.01); *G09G 2300/0871* (2013.01);
(Continued)

(58) Field of Classification Search
CPC ..... G09G 3/367–3/3696; G09G 2300/0871; G09G 2310/08; G09G 2310/0248; G09G 2310/0251; G09G 2310/0289; G09G 2310/0267; G09G 2310/0245; G09G 2310/063; G09G 2320/0257; G09G 2330/021; G09G 2330/027; G09G 2330/02; G09G 2330/028; G09G 2330/04; G02F 1/136204; H02H 9/00
See application file for complete search history.

(56) References Cited

U.S. PATENT DOCUMENTS

2015/0179128 A1* 6/2015 Huang ..... G09G 5/00 315/169.1
2015/0331269 A1* 11/2015 Chen ..... G02F 1/136286 349/33

* cited by examiner

*Primary Examiner* — Grant Sitta
*Assistant Examiner* — Amen Bogale
(74) *Attorney, Agent, or Firm* — Andrew C. Cheng

(57) ABSTRACT

The present invention provides a panel signal control circuit, a display panel and a display device. The panel signal control circuit comprises: a PWM IC and a level shift IC, and the panel signal control circuit comprises further comprises: a Vin voltage divider circuit; one end of the Vin voltage divider circuit is coupled to an input port of an input working voltage Vin of the PWM IC, and the other end of the Vin voltage divider circuit is grounded; a voltage divider interface of the Vin voltage divider circuit is coupled to a pin a of the Level shift IC, and the pin a is a voltage monitor pin, and as the voltage of the pin a is lower than an activation voltage threshold, respective output clock CK pins of the Level shift IC output sync signals of an output working voltage VGH of the PWM IC.

9 Claims, 3 Drawing Sheets

(52) U.S. Cl.
CPC ..... *G09G 2310/0248* (2013.01); *G09G 2310/0289* (2013.01); *G09G 2310/08* (2013.01); *G09G 2320/0257* (2013.01); *G09G 2330/021* (2013.01)

PANEL SIGNAL CONTROL CIRCUIT, DISPLAY PANEL AND DISPLAY DEVICE

CROSS REFERENCE

This application claims the priority of Chinese Patent Application No. 201510638626.X, entitled "Panel signal control circuit, display panel and display device", filed on Sep. 30, 2015, the disclosure of which is incorporated herein by reference in its entirety.

FIELD OF THE INVENTION

The present invention relates to a display field, and more particularly to a panel signal control circuit, a display panel and a display device.

BACKGROUND OF THE INVENTION

The panel, so called LCD (Liquid Crystal Display), is a common electronic display device. The present panel such as GOA (Gate driver on Array) panel is instantly powered off, the liquid crystal capacitor of the panel cannot be completely discharged. Such incomplete liquid crystal capacitor can cause the panel display ghost.

For solving the issue of the panel display ghost, the prior art provides a panel signal control circuit. Please refer to FIG. 1. The panel signal control circuit provided by prior art comprises: a PWM IC (Pulse-Width Modulation Integrated circuit) 10 and a level shift IC 11. Please refer to FIG. 2. FIG. 2 is a signal diagram of respective signals of the circuit in FIG. 1. VGH and the TFT (Thin Film Transistor) in panel control the electrode high voltage level. VGH is also the output working voltage of the PWM IC. XAO can be a voltage inversion signal inputted to the level shift IC after the GOA panel is powered off and the PWM IC stops working. After the level shift IC receives the XAO signal, the Discharge function is activated. The Discharge function specifically comprises: synchronizing respective output CK (clock) signals with the VGH signal, and after synchronization, the respective output CK signals drops along with the descend of VGH. As shown in FIG. 2, after the GOA panel is powered off, VGH remains to be high voltage level in a period of time. The respective output CK signals are synchronized with VGH, thus the TFTs coupled to the respective output CK signals still can be in the activation state to make the rest electric charge on the liquid crystal capacitor is released to ground through the activated TFTs. Consequently, the liquid crystal is discharged to eliminate the panel display ghost.

In the solution of realizing prior art, the following technical issue is found:

Please refer to FIG. 2. Because the respective output CK signals are synchronized with VGH, the voltage value of VGH has already been dropped, and the voltage values of the respective output CK signals synchronized with VGH also will drop. Accordingly, the voltage values of the respective output CK signals are insufficient, and the time period that the TFTs coupled to the respective output CK signals cannot be activated or activated gets short. The discharge of the liquid crystal capacitor is incomplete, and the elimination of the panel display ghost is incomplete.

SUMMARY OF THE INVENTION

First, a panel signal control circuit is provided, and the panel signal control circuit comprises: a Pulse width modulation integrated circuit (PWM IC) and a voltage level transfer integrated circuit (Level shift IC), wherein the panel signal control circuit further comprises:

a Vin voltage divider circuit; one end of the Vin voltage divider circuit is coupled to an input port of an input working voltage Vin of the PWM IC, and the other end of the Vin voltage divider circuit is grounded; a voltage divider interface of the Vin voltage divider circuit is coupled to a pin a of the Level shift IC, and the pin a is a voltage monitor pin, and as the voltage of the pin a is lower than an activation voltage threshold, respective output clock CK pins of the Level shift IC output sync signals of an output working voltage VGH of the PWM IC.

The Vin voltage divider circuit comprises: two resistors, a resistor R1 and a resistor R2 coupled in series; wherein the other end of the resistor R1 and one end of the resistor R2 are the voltage divider interface of the Vin voltage divider circuit, and one end of the resistor R1 and the other end of the resistor R2 respectively are the two ends of the Vin voltage divider circuit.

The panel signal control circuit further comprises: a VGH voltage divider circuit; one end of the VGH voltage divider circuit is coupled to a VGH output port of the PWM IC, and the VGH voltage divider circuit is grounded, and a voltage divider interface of the VGH voltage divider circuit is coupled to a pin b of the level shift IC, and the pin b is another voltage monitor pin, and as the voltage of the pin b is lower than a deactivation voltage threshold, the respective output CK pins output low voltage level signals.

The VGH voltage divider circuit comprises: two resistors, a resistor R3 and a resistor R4 coupled in series; wherein the other end of the resistor R3 and one end of the resistor R4 are the voltage divider interface of the VGH voltage divider circuit, and one end of the resistor R3 and the other end of the resistor R4 respectively are the two ends of the VGH voltage divider circuit.

The VGH voltage divider circuit comprises: a variable resistor, and two interfaces of the variable resistor respectively are the two ends of the VGH voltage divider circuit, and a resistance adjustment interface of the variable resistor is the voltage divider interface of the VGH voltage divider circuit.

Combing with first optional solution, in the fifth optional solution, the panel signal control circuit further comprises: a VGH voltage divider circuit; one end of the VGH voltage divider circuit is coupled to a VGH output port of the PWM IC, and the VGH voltage divider circuit is grounded, and a voltage divider interface of the VGH voltage divider circuit is coupled to a pin b of the level shift IC, and the pin b is another voltage monitor pin, and as the voltage of the pin b is lower than a deactivation voltage threshold, the respective output CK pins output low voltage level signals.

Second, a display panel is provided, and the display panel comprises a panel signal control circuit, and the panel signal control circuit comprises: a Pulse width modulation integrated circuit (PWM IC) and a voltage level transfer integrated circuit (Level shift IC), wherein the panel signal control circuit further comprises:

a Vin voltage divider circuit; one end of the Vin voltage divider circuit is coupled to an input port of an input working voltage Vin of the PWM IC, and the other end of the Vin voltage divider circuit is grounded; a voltage divider interface of the Vin voltage divider circuit is coupled to a pin a of the Level shift IC, and the pin a is a voltage monitor pin, and as the voltage of the pin a is lower than an activation voltage threshold, respective output clock CK pins of the Level shift IC output sync signals of an output working voltage VGH of the PWM IC.

The Vin voltage divider circuit comprises: two resistors, a resistor R1 and a resistor R2 coupled in series; wherein the other end of the resistor R1 and one end of the resistor R2 are the voltage divider interface of the Vin voltage divider circuit, and one end of the resistor R1 and the other end of the resistor R2 respectively are the two ends of the Vin voltage divider circuit.

The panel signal control circuit further comprises: a VGH voltage divider circuit; one end of the VGH voltage divider circuit is coupled to a VGH output port of the PWM IC, and the VGH voltage divider circuit is grounded, and a voltage divider interface of the VGH voltage divider circuit is coupled to a pin b of the level shift IC, and the pin b is another voltage monitor pin, and as the voltage of the pin b is lower than a deactivation voltage threshold, the respective output CK pins output low voltage level signals.

The VGH voltage divider circuit comprises: two resistors, a resistor R3 and a resistor R4 coupled in series; wherein the other end of the resistor R3 and one end of the resistor R4 are the voltage divider interface of the VGH voltage divider circuit, and one end of the resistor R3 and the other end of the resistor R4 respectively are the two ends of the VGH voltage divider circuit.

The VGH voltage divider circuit comprises: a variable resistor, and two interfaces of the variable resistor respectively are the two ends of the VGH voltage divider circuit, and a resistance adjustment interface of the variable resistor is the voltage divider interface of the VGH voltage divider circuit.

The panel signal control circuit further comprises: a VGH voltage divider circuit; one end of the VGH voltage divider circuit is coupled to a VGH output port of the PWM IC, and the VGH voltage divider circuit is grounded, and a voltage divider interface of the VGH voltage divider circuit is coupled to a pin b of the level shift IC, and the pin b is another voltage monitor pin, and as the voltage of the pin b is lower than a deactivation voltage threshold, the respective output CK pins output low voltage level signals.

Third, a display device is provided, and the display device comprises a display panel, wherein the display panel comprises a panel signal control circuit, and the panel signal control circuit comprises: a Pulse width modulation integrated circuit (PWM IC) and a voltage level transfer integrated circuit (Level shift IC), wherein the panel signal control circuit further comprises:

a Vin voltage divider circuit; one end of the Vin voltage divider circuit is coupled to an input port of an input working voltage Vin of the PWM IC, and the other end of the Vin voltage divider circuit is grounded; a voltage divider interface of the Vin voltage divider circuit is coupled to a pin a of the Level shift IC, and the pin a is a voltage monitor pin, and as the voltage of the pin a is lower than an activation voltage threshold, respective output clock CK pins of the Level shift IC output sync signals of an output working voltage VGH of the PWM IC.

The Vin voltage divider circuit comprises: two resistors, a resistor R1 and a resistor R2 coupled in series; wherein the other end of the resistor R1 and one end of the resistor R2 are the voltage divider interface of the Vin voltage divider circuit, and one end of the resistor R1 and the other end of the resistor R2 respectively are the two ends of the Vin voltage divider circuit.

The panel signal control circuit further comprises: a VGH voltage divider circuit; one end of the VGH voltage divider circuit is coupled to a VGH output port of the PWM IC, and the VGH voltage divider circuit is grounded, and a voltage divider interface of the VGH voltage divider circuit is coupled to a pin b of the level shift IC, and the pin b is another voltage monitor pin, and as the voltage of the pin b is lower than a deactivation voltage threshold, the respective output CK pins output low voltage level signals.

The VGH voltage divider circuit comprises: two resistors, a resistor R3 and a resistor R4 coupled in series; wherein the other end of the resistor R3 and one end of the resistor R4 are the voltage divider interface of the VGH voltage divider circuit, and one end of the resistor R3 and the other end of the resistor R4 respectively are the two ends of the VGH voltage divider circuit.

The VGH voltage divider circuit comprises: a variable resistor, and two interfaces of the variable resistor respectively are the two ends of the VGH voltage divider circuit, and a resistance adjustment interface of the variable resistor is the voltage divider interface of the VGH voltage divider circuit.

The panel signal control circuit further comprises: a VGH voltage divider circuit; one end of the VGH voltage divider circuit is coupled to a VGH output port of the PWM IC, and the VGH voltage divider circuit is grounded, and a voltage divider interface of the VGH voltage divider circuit is coupled to a pin b of the level shift IC, and the pin b is another voltage monitor pin, and as the voltage of the pin b is lower than a deactivation voltage threshold, the respective output CK pins output low voltage level signals.

According to the panel signal control circuit, the display panel and the display device, With the addition of the voltage divider circuit to the input working voltage (Vin) of the PWM IC, and controlling the level shift IC to activate the discharge function according to the input working voltage of the PWM IC, VGH remain to be at the normal working voltage when Vin drops to trigger the level shift IC to synchronize respective output CK signals and VGH due to the Vin of the PWM IC and the output working voltage VGH has a certain time delay. Then, the respective output CK signals synchronized with the VGH are also in the high voltage level state (i.e. VGH is not in drop state) to raise the activation voltage of the TFT to make the TFT coupled to the respective output CK signals completely activated to increase the activation period of the TFT. Thus the liquid crystal panel capacitor is completely discharged, and no display ghost appears.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Figure 1:
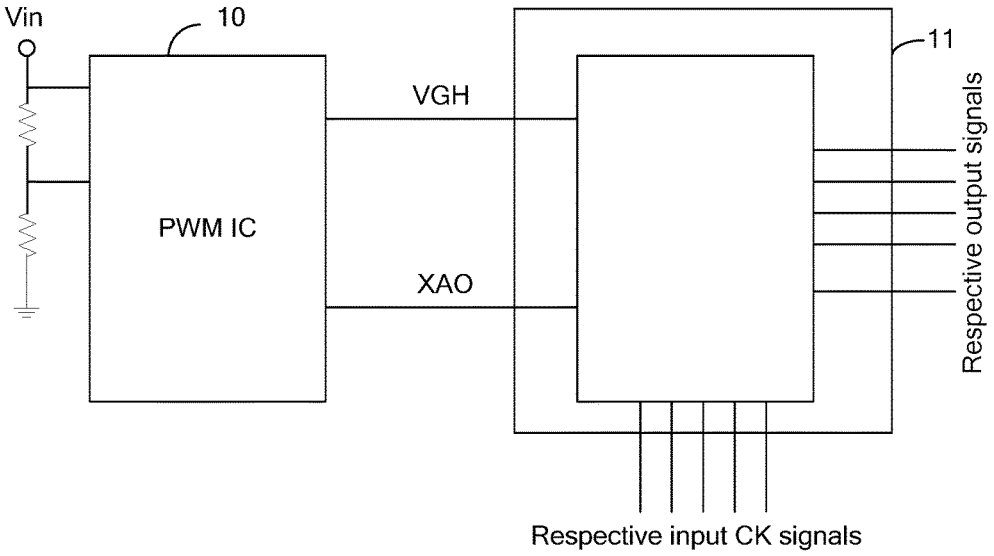
FIG. 1 is a diagram of a panel signal control circuit according to prior art.
Figure 2:
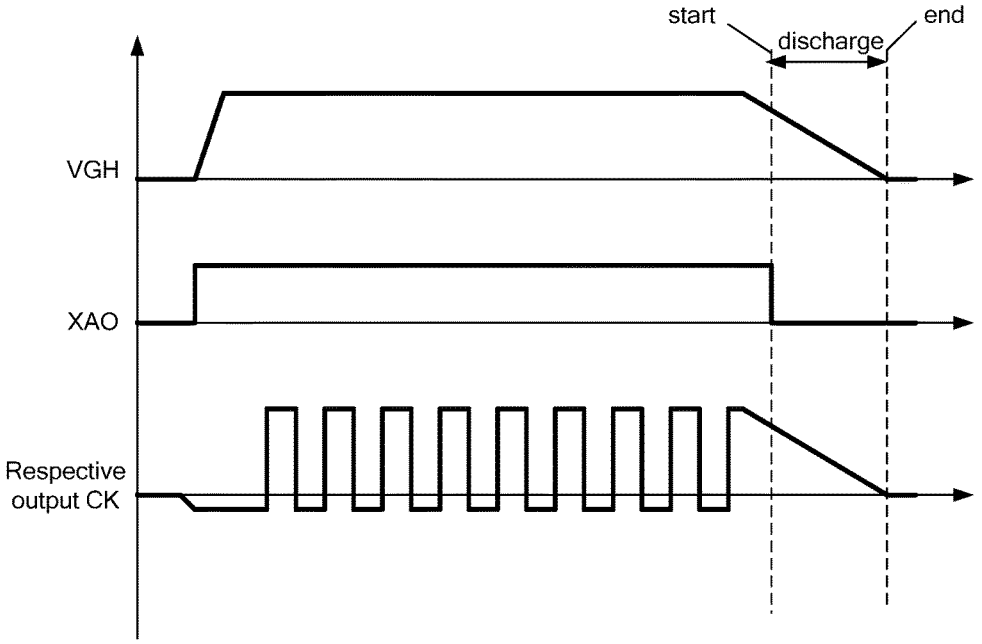
FIG. 2 is a signal diagram of respective signals of the panel signal control circuit according to prior art.
Figure 3:
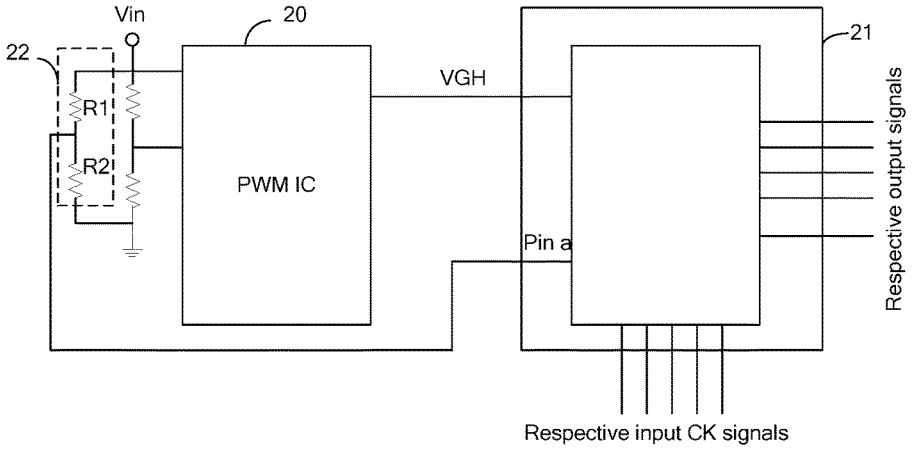
FIG. 3 is a diagram of a panel signal control circuit according to the first preferred embodiment of the present invention.

Please refer to FIG. 3. FIG. 3 is a diagram of a panel signal control circuit according to the first preferred embodiment of the present invention. As shown in FIG. 3, the panel signal control circuit comprises: a PWM IC 20 and a level shift IC 21 and a Vin voltage divider circuit 22; one end of the Vin voltage divider circuit 22 is coupled to an input port of the Vin of the PWM IC 20, and the other end is grounded; a voltage divider interface of the Vin voltage divider circuit 22 is coupled to a pin a of the level shift IC 21, and the pin a is a voltage monitor pin, and as the voltage of the pin a is lower than an activation voltage threshold, respective output clock CK pins of the Level shift IC 21 output sync signals of the VGH of the PWM IC.

In one embodiment in the first preferred embodiment of the present invention, the Vin voltage divider circuit 22 can be two resistors, a resistor R1 and a resistor R2 coupled in series shown in FIG. 3; wherein the other end of the resistor R1 and one end of the resistor R2 are the voltage divider interface of the Vin voltage divider circuit, and one end of the resistor R1 and the other end of the resistor R2 respectively are the two ends of the Vin voltage divider circuit. In other embodiment of the present invention, the Vin voltage divider circuit 22 can be a variable resistor, and two interfaces of the variable resistor respectively can be the two ends of the VGH voltage divider circuit 22, and a resistance adjustment interface of the variable resistor can be the voltage divider interface of the Vin voltage divider circuit 22. Certainly, the Vin voltage divider circuit in the embodiment of the present invention can have other forms. The specific embodiment of the present invention is not limited to the specific forms of the aforesaid Vin voltage divider circuit.

The valuing principle of the value of R1/R2 is explained with one common PWM IC and the Level shift IC below. The first preferred embodiment of the present invention is not restricted to the specific range of the value of R1/R2. The value of R1/R2 has to be determined according to the normal working voltage range of the PWM IC. The CS901 IC (a common type of the PWM IC) is illustrated. The lowest normal working voltage is 8V (The input voltage Vin which is generally applied to the PWM IC is 12V), and before the PWM IC stops the normal working (Vin>8V, and smaller than 12V to prevent that as the PWM IC inputs 12V, the Discharge function of the Level shift IC is in on state all the time, and thus the voltage value when the first preferred embodiment of the present invention activates the Discharge function can be set between 8-8.5V), i.e. the detected voltage Va of the pin a of the Level shift IC is smaller than the activation voltage threshold at the first time, Vin needs to be in 8-8.5V. Namely, when Vin*R2/(R1+R2)<=Va, Vin needs to be in 8-8.5V, and 8<Va*(R1+R2)/R2<8.5. Hypothetically, the activation voltage threshold of Va is set to be 0.5V, and it can be calculated that 15<R1/R2<16.

Figure 4:
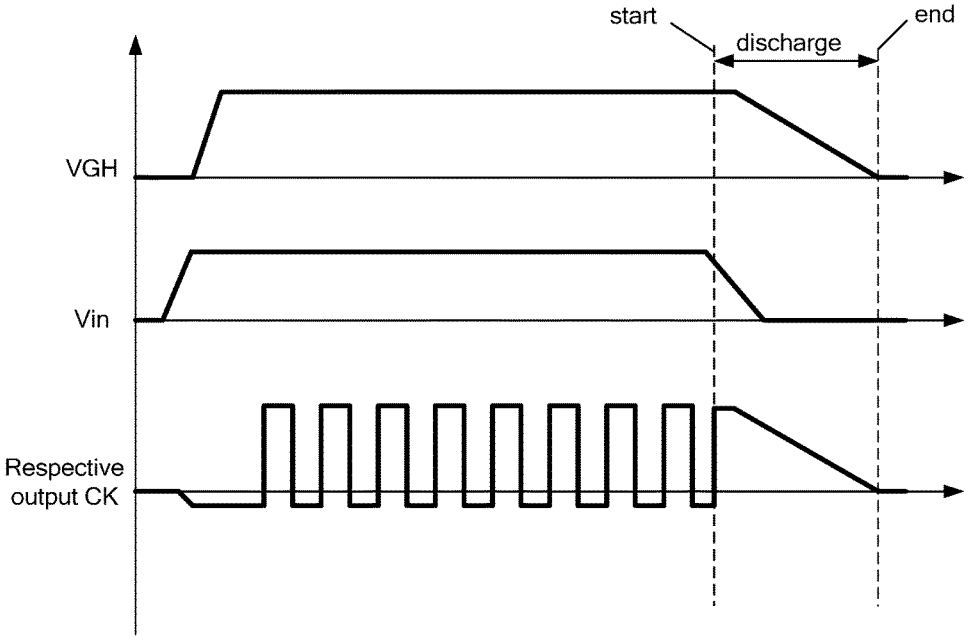
FIG. 4 is a signal diagram of respective signal of the panel signal control circuit according to the first preferred embodiment of the present invention.

Please refer to FIG. 4. FIG. 4 is a signal diagram of respective signal of the panel signal control circuit according to the first preferred embodiment of the present invention. As shown in FIG. 4, the voltage of Vin is the input working voltage of the PWM IC, and as the panel is powered off, and the PWM IC stops working, the voltage of Vin drops first. Then, the voltage value of pin a coupled to the voltage divider interface of the Vin voltage divider circuit certainly will drop. When the voltage value of pin a drops to the activation voltage threshold value, the Discharge function is activated, i.e. the level shift IC 21 synchronizes the respective output CK signals and VGH signal, the respective output CK signals of the level shift IC 21 output VGH. Then, the TFTs coupled to the respective output CK signals are activated. Because VGH and Vin have some delay (as shown in FIG. 4), in the just beginning, VGH remains to be the normal working voltage of the PWM IC, and the activation voltages of the TFTs coupled to the respective output CK signals are VGH normal working voltage, which is higher than the activation voltage of the TFT in prior art. Thus, the TFT can be completely activated to make the liquid crystal panel capacitor start being discharged. As shown in FIG. 4, the signal diagram of the respective CK signals shows dropping along with the descend of VGH, and ultimately drops to zero voltage level. When the voltages of the respective CK signals drop under the activation voltage of the TFT, the TFTs are deactivated, and the liquid crystal capacitor stops discharging. For the first preferred embodiment of the present invention, VGH has not dropped when the TFT is activated but in prior, the TFT only can be activated when VGH drops. Thu, the TFT activation period in the first preferred embodiment of the present invention is longer than TFT activation period in prior art. Consequently, the TFT activation voltage in the first preferred embodiment of the present invention is high, and the activation period is long. The liquid crystal panel capacitor is completely discharged, and no display ghost appears.

Besides, the voltage divider circuit provided by the first preferred embodiment of the present invention also effectively reduces the cost of the level shift IC. For the pin a, which is a voltage monitoring pin, and the sensitivity is higher. If Vin is directly applied to pin a, then a comparison voltage which is similar to the Vin voltage value has to added in the level shift IC, and the Vin voltage value is higher (generally between 8-12V), and once one higher comparison voltage is added inside the level shift IC, the cost of the level shift IC is inevitably increased. Moreover, the addition of one higher comparison voltage in the level shift IC can easily cause the condition of internal short in the level shift IC. Once the voltage divider circuit is utilize, this problem can be well solved, which reduce the monitoring voltage. Thus, the addition of the Vin voltage divider circuit can effectively reduce the cost of the level shift IC, and effectively reduce the failure rate of the level shift IC.

Figure 5:
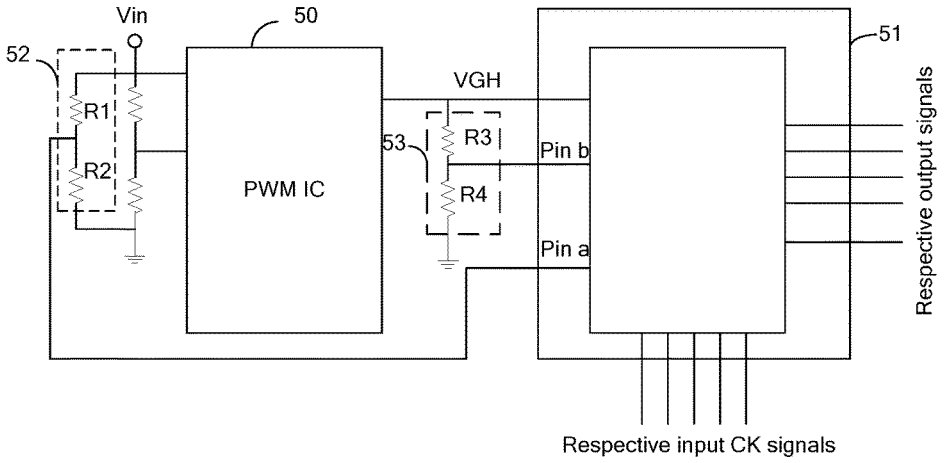
FIG. 5 is a signal diagram of respective signal of the panel signal control circuit according to the second preferred embodiment of the present invention.

Please refer to FIG. 5. FIG. 5 is a signal diagram of respective signal of the panel signal control circuit according to the second preferred embodiment of the present invention. As shown in FIG. 5, the panel signal control circuit comprises: a PWM IC 50, a level shift IC 51, a Vin voltage divider circuit 52 and a VGH voltage divider circuit 54; one end of the Vin voltage divider circuit 52 is coupled to an input port of a Vin input port of the PWM IC 50, and the other end of the Vin voltage divider circuit 52 is grounded; a voltage divider interface of the Vin voltage divider circuit 52 is coupled to a pin a of the Level shift IC 51, and the pin a can be a voltage monitor pin, and as the voltage of the pin a is lower than an activation voltage threshold, respective output CK pins of the Level shift IC 51 output sync signals of VGH; one end of the VGH voltage divider circuit is coupled to a VGH output port of the PWM IC, and the VGH voltage divider circuit is grounded, and a voltage divider interface of the VGH voltage divider circuit 53 is coupled to a pin b of the level shift IC 51, and the pin b can be a voltage monitor pin, and as the voltage of the pin b is lower than a deactivation voltage threshold, the respective output CK pins of the level shift IC 51 output low voltage level signals.

In one embodiment in the second preferred embodiment of the present invention, the specific structure of the Vin voltage divider circuit can be referred to the description of the first preferred embodiment of the present invention. The VGH voltage divider circuit 53 can be two resistors, a resistor R3 and a resistor R4 coupled in series shown in FIG. 5; wherein the other end of the resistor R3 and one end of the resistor R4 are the voltage divider interface of the VGH voltage divider circuit 53, and one end of the resistor R3 and the other end of the resistor R4 respectively are the two ends of the VGH voltage divider circuit 53. In another embodiment in the second preferred embodiment of the present invention, the VGH voltage divider circuit 53 can a variable resistor, and two interfaces of the variable resistor respectively are the two ends of the VGH voltage divider circuit 53, and a resistance adjustment interface of the variable resistor is the voltage divider interface of the VGH voltage divider circuit 53. Certainly, the VGH voltage divider circuit in the embodiment of the present invention can have other forms. The specific embodiment of the present invention is not limited to the specific forms of the aforesaid VGH voltage divider circuit.

The valuing principle of the value of R1/R2 and the value of R3/R4 is explained with one common PWM IC and the Level shift IC below. The second preferred embodiment of the present invention is not restricted to the specific range of the value of R1/R2 and not restricted to the specific range of the value of R3/R4, either. The value of R1/R2 has to be determined according to the normal working voltage range of the PWM IC. The CS901 IC (a common type of the PWM IC) is illustrated. The lowest normal working voltage is 8V (The input voltage Vin which is generally applied to the PWM IC is 12V), and before the PWM IC stops the normal working (Vin>8V, and smaller than 12V to prevent that as the PWM IC inputs 12V, the Discharge function of the Level shift IC is in on state all the time, and thus the voltage value when the second preferred embodiment of the present invention activates the Discharge function can be set between 8-8.5V), i.e. the detected voltage Va of the pin a of the Level shift IC is smaller than the activation voltage threshold at the first time, Vin needs to be in 8-8.5V. Namely, when Vin*R2/(R1+R2)<=Va, Vin needs to be in 8-8.5V, and 8<Va*(R1+R2)/R2<8.5. Hypothetically, the activation voltage threshold of Va is set to be 0.5V, and it can be calculated that 15<R1/R2<16. The specific valuing principle of the values of the aforesaid R3/R4 can be: the monitoring voltage of pin b is set to be Vb, and if the deactivation voltage threshold is also set to be 0.5V, as the PWM IC normally works, the voltage of VGH is about 30V, and as the voltage value is smaller than about 10V, the effective activation of TFT can no longer ensured. Thus, as VGH*R4/(R3+R4)<=Vb, VGH has to be between 10-30V. Then, 10<Vb*(R3+R4)/R4<30, and it can be calculated that 19<R3/R4<59.

Figure 6:
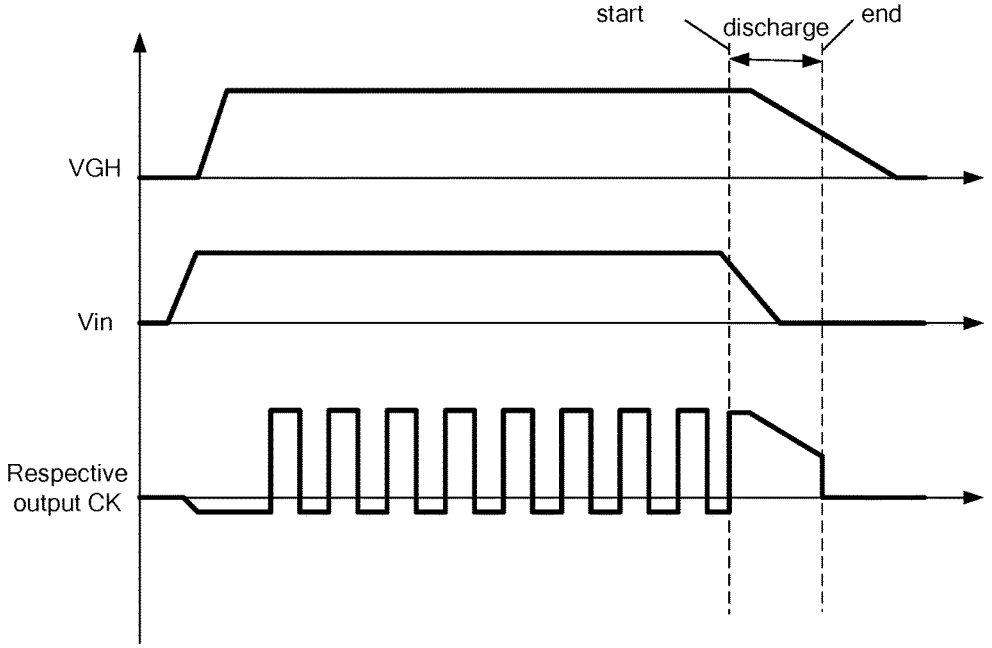
FIG. 6 is a diagram of a voltage divider circuits in the first, second embodiments of the present invention.

Please refer to FIG. 6. FIG. 6 is a diagram of a voltage divider circuits in the first, second embodiments of the present invention. As shown in FIG. 6, the voltage of Vin is the input working voltage, and as the panel is powered off, and the PWM IC 50 stops working, the voltage of Vin drops first. Then, the voltage value of pin a coupled to the voltage divider interface of the Vin voltage divider circuit certainly will drop. When it drops to the activation voltage threshold value, the Discharge function is activated, i.e. the level shift IC 51 synchronizes the respective output CK signals and VGH signal, the respective output CK signals of the level shift IC 51 output VGH. Then, the TFTs coupled to the respective output CK signals are activated. Because VGH and Vin have some delay, in the just beginning, VGH outputted by the respective output CK signals remain to be the normal working voltage of the PWM IC 50, and the activation voltages of the TFTs coupled to the respective output CK signals are the normal working voltage of the PWM IC 50. The voltage value of VGH has not dropped, and thus is higher than the activation voltage of the TFT in prior art. Thus, the TFT can be completely activated to make the liquid crystal panel capacitor start being discharged. As shown in FIG. 6, the signal diagram of the respective CK signals shows dropping along with the descend of VGH, and then the voltage value of pin b coupled to the voltage divider interface of the voltage divider circuit will definitely drop. When it drops under the deactivation voltage threshold value, the level shift IC 51 changes the respective output CK signals from the sync signals of VGH to low voltage level, and the TFT is deactivated, and the liquid crystal capacitor stops being discharged. For the second preferred embodiment of the present invention, the activation and the deactivation of the TFT is controlled by the level shift IC, thus, the period of the Discharge function is controllable. The period of the Discharge function can be adjusted for satisfying the loading requirement for the GOA panels of various sizes. Besides, the low voltage level outputted by the respective output CK signals of the level shift IC 51 can effectively reduce the power consumption of the liquid crystal panel and the TFT polarization. Compared with the first preferred embodiment of the present invention, the respective output CK signals are synchronized with VGH. Therefore, as VGH has not reached zero, the respective output CK signals are applied to the control electrode (G electrode) of the TFT. Consequently, the TFT leakage current will definitely occur and the consumption of the TFT will be increase to increase the power consumption of the liquid crystal panel. Moreover, the long term voltage application to the control electrode of the TFT will cause the TFT polarization. Because the TFT is a switch of rapid on/off, the long term activation state of the TFT will result in the TFT polarization, and the TFT polarization phenomenon occurs. The switch speed of the TFT is affected. Such condition can cause the decrease of the switch speed of the display image on the liquid crystal panel. In conclusion, the second preferred embodiment of the present invention will not have the panel display ghost but have advantages of Discharge function period adjustment and TFT polarization reduction.

Besides, the voltage divider circuit provided by the second preferred embodiment of the present invention also effectively reduces the cost of the level shift IC. For the pin a, which is a voltage monitoring pin, and the sensitivity is higher. If Vin is directly applied to pin a, then a comparison voltage which is similar to the Vin voltage value has to added in the level shift IC, and the Vin voltage value is higher, and once one higher comparison voltage is added inside the level shift IC, the cost of the level shift IC is inevitably increased. Moreover, the addition of one higher comparison voltage in the level shift IC can easily cause the condition of internal short in the level shift IC. Once the voltage divider circuit is utilize, this problem can be well solved, which does not only reduce the monitoring voltage but also reduces the sensitivity of the voltage monitoring a little. Thus, the addition of the Vin voltage divider circuit can effectively reduce the cost of the level shift IC. Similarly, the VGH voltage divider circuit also can effectively reduce the cost of the level shift IC.

Besides, the present invention further provides a display panel, and the display panel comprises: a panel signal control circuit. Please refer to FIG. 3. FIG. 3 is a diagram of a panel signal control circuit according to the first preferred embodiment of the present invention. As shown in FIG. 3, the panel signal control circuit comprises: a PWM IC 20 and a level shift IC 21 and a Vin voltage divider circuit 22; two ends of the Vin voltage divider circuit 22 are respectively coupled to an input port of the Vin of the PWM IC 20 and grounded; a voltage divider interface of the Vin voltage divider circuit 22 is coupled to a pin a of the level shift IC 21, and the pin a is a voltage monitor pin, and as the voltage of the pin a is lower than an activation voltage threshold, respective output clock CK pins of the Level shift IC 21 output sync signals of the VGH of the PWM IC.

In one embodiment in the first preferred embodiment of the present invention, the Vin voltage divider circuit 22 can be two resistors, a resistor R1 and a resistor R2 coupled in series shown in FIG. 3; wherein the other end of the resistor R1 and one end of the resistor R2 are the voltage divider interface of the Vin voltage divider circuit 22, and one end of the resistor R1 and the other end of the resistor R2 respectively are the two ends of the Vin voltage divider circuit 22. In other embodiment of the present invention, the Vin voltage divider circuit 22 can be a variable resistor, and two interfaces of the variable resistor respectively can be the two ends of the VGH voltage divider circuit 22, and a resistance adjustment interface of the variable resistor can be the voltage divider interface of the VGH voltage divider circuit 22. Certainly, the Vin voltage divider circuit in the embodiment of the present invention can have other forms. The specific embodiment of the present invention is not limited to the specific forms of the aforesaid Vin voltage divider circuit.

The valuing principle of the value of R1/R2 is explained with one common PWM IC and the Level shift IC below. The first preferred embodiment of the present invention is not restricted to the specific range of the value of R1/R2. The value of R1/R2 has to be determined according to the normal working voltage range of the PWM IC. The CS901 IC (a common type of the PWM IC) is illustrated. The lowest normal working voltage is 8V (The input voltage Vin which is generally applied to the PWM IC is 12V), and before the PWM IC stops the normal working (Vin>8V, and smaller than 12V to prevent that as the PWM IC inputs 12V, the Discharge function of the Level shift IC is in on state all the time, and thus the voltage value when the first preferred embodiment of the present invention activates the Discharge function can be set between 8-8.5V), i.e. the detected voltage Va of the pin a of the Level shift IC is smaller than the activation voltage threshold at the first time, Vin needs to be in 8-8.5V. Namely, when Vin*R2/(R1+R2)<=Va, Vin needs to be in 8-8.5V, and 8<Va*(R1+R2)/R2<8.5. Hypothetically, the activation voltage threshold of Va is set to be 0.5V, and it can be calculated that 15<R1/R2<16.

Please refer to FIG. 4. FIG. 4 is a signal diagram of respective signal of the panel signal control circuit according to the first preferred embodiment of the present invention. As shown in FIG. 4, the voltage of Vin is the input working voltage of the PWM IC, and as the panel is powered off, and the PWM IC stops working, the voltage of Vin drops first. Then, the voltage value of pin a coupled to the voltage divider interface of the Vin voltage divider circuit certainly will drop. When the voltage value of pin a drops to the activation voltage threshold value, the Discharge function is activated, i.e. the level shift IC 21 synchronizes the respective output CK signals and VGH signal, the respective output CK signals of the level shift IC 21 output VGH. Then, the TFTs coupled to the respective output CK signals are activated. Because VGH and Vin have some delay (as shown in FIG. 4), in the just beginning, VGH remains to be the normal working voltage of the PWM IC, and the activation voltages of the TFTs coupled to the respective output CK signals are VGH normal working voltage, which is higher than the activation voltage of the TFT in prior art. Thus, the TFT can be completely activated to make the liquid crystal panel capacitor start being discharged. As shown in FIG. 4, the signal diagram of the respective CK signals shows dropping along with the descend of VGH, and ultimately drops to zero voltage level. When the voltages of the respective CK signals drop under the activation voltage of the TFT, the TFTs are deactivated, and the liquid crystal capacitor stops discharging. For the first preferred embodiment of the present invention, VGH has not dropped when the TFT is activated but in prior, the TFT only can be activated when VGH drops. Thu, the TFT activation period in the first preferred embodiment of the present invention is longer than TFT activation period in prior art. Consequently, the TFT activation voltage in the first preferred embodiment of the present invention is high, and the activation period is long. The liquid crystal panel capacitor is completely discharged, and no display ghost appears.

Besides, the voltage divider circuit provided by the first preferred embodiment of the present invention also effectively reduces the cost of the level shift IC. For the pin a, which is a voltage monitoring pin, and the sensitivity is higher. If Vin is directly applied to pin a, then a comparison voltage which is similar to the Vin voltage value has to added in the level shift IC, and the Vin voltage value is higher (generally between 8-12V), and once one higher comparison voltage is added inside the level shift IC, the cost of the level shift IC is inevitably increased. Moreover, the addition of one higher comparison voltage in the level shift IC can easily cause the condition of internal short in the level shift IC. Once the voltage divider circuit is utilize, this problem can be well solved, which reduce the monitoring voltage. Thus, the addition of the Vin voltage divider circuit can effectively reduce the cost of the level shift IC, and effectively reduce the failure rate of the level shift IC.

Please refer to FIG. 5. FIG. 5 is a signal diagram of respective signal of the panel signal control circuit according to the second preferred embodiment of the present invention. As shown in FIG. 5, the panel signal control circuit comprises: a PWM IC 50, a level shift IC 51, a Vin voltage divider circuit 52 and a VGH voltage divider circuit 54; one end of the Vin voltage divider circuit 52 is coupled to an input port of a Vin input port of the PWM IC 50, and the other end of the Vin voltage divider circuit 52 is grounded; a voltage divider interface of the Vin voltage divider circuit 52 is coupled to a pin a of the Level shift IC 51, and the pin a can be a voltage monitor pin, and as the voltage of the pin a is lower than an activation voltage threshold, respective output CK pins of the Level shift IC 51 output sync signals of VGH; one end of the VGH voltage divider circuit is coupled to a VGH output port of the PWM IC, and the VGH voltage divider circuit is grounded, and a voltage divider interface of the VGH voltage divider circuit 53 is coupled to a pin b of the level shift IC 51, and the pin b can be a voltage monitor pin, and as the voltage of the pin b is lower than a deactivation voltage threshold, the respective output CK pins of the level shift IC 51 output low voltage level signals.

In one embodiment in the second preferred embodiment of the present invention, the specific structure of the Vin voltage divider circuit can be referred to the description of the first preferred embodiment of the present invention. The VGH voltage divider circuit 53 can be two resistors, a resistor R3 and a resistor R4 coupled in series shown in FIG. 5; wherein the other end of the resistor R3 and one end of the resistor R4 are the voltage divider interface of the VGH voltage divider circuit 53, and one end of the resistor R3 and the other end of the resistor R4 respectively are the two ends of the VGH voltage divider circuit 53. In another embodiment in the second preferred embodiment of the present invention, the VGH voltage divider circuit 53 can a variable resistor, and two interfaces of the variable resistor respectively are the two ends of the VGH voltage divider circuit 53, and a resistance adjustment interface of the variable resistor is the voltage divider interface of the VGH voltage divider circuit 53. Certainly, the VGH voltage divider circuit in the embodiment of the present invention can have other forms. The specific embodiment of the present invention is not limited to the specific forms of the aforesaid VGH voltage divider circuit.

The valuing principle of the value of R1/R2 and the value of R3/R4 is explained with one common PWM IC and the Level shift IC below. The second preferred embodiment of the present invention is not restricted to the specific range of the value of R1/R2 and not restricted to the specific range of the value of R3/R4, either. The value of R1/R2 has to be determined according to the normal working voltage range of the PWM IC. The CS901 IC (a common type of the PWM IC) is illustrated. The lowest normal working voltage is 8V (The input voltage Vin which is generally applied to the PWM IC is 12V), and before the PWM IC stops the normal working (Vin>8V, and smaller than 12V to prevent that as the PWM IC inputs 12V, the Discharge function of the Level shift IC is in on state all the time, and thus the voltage value when the second preferred embodiment of the present invention activates the Discharge function can be set between 8-8.5V), i.e. the detected voltage Va of the pin a of the Level shift IC is smaller than the activation voltage threshold at the first time, Vin needs to be in 8-8.5V. Namely, when Vin*R2/(R1+R2)<=Va, Vin needs to be in 8-8.5V, and 8<Va*(R1+R2)/R2<8.5. Hypothetically, the activation voltage threshold of Va is set to be 0.5V, and it can be calculated that 15<R1/R2<16. The specific valuing principle of the values of the aforesaid R3/R4 can be: the monitoring voltage of pin b is set to be Vb, and if the deactivation voltage threshold is also set to be 0.5V, as the PWM IC normally works, the voltage of VGH is about 30V, and as the voltage value is smaller than about 10V, the effective activation of TFT can no longer ensured. Thus, as VGH*R4/(R3+R4)<=Vb, VGH has to be between 10-30V. Then, 10<Vb*(R3+R4)/R4<30, and it can be calculated that 19<R3/R4<59.

Please refer to FIG. 6. FIG. 6 is a diagram of a voltage divider circuits in the first, second embodiments of the present invention. As shown in FIG. 6, the voltage of Vin is the input working voltage, and as the panel is powered off, and the PWM IC 50 stops working, the voltage of Vin drops first. Then, the voltage value of pin a coupled to the voltage divider interface of the Vin voltage divider circuit certainly will drop. When it drops to the activation voltage threshold value, the Discharge function is activated, i.e. the level shift IC 51 synchronizes the respective output CK signals and VGH signal, the respective output CK signals of the level shift IC 51 output VGH. Then, the TFTs coupled to the respective output CK signals are activated. Because VGH and Vin have some delay, in the just beginning, VGH outputted by the respective output CK signals remain to be the normal working voltage of the PWM IC 50, and the activation voltages of the TFTs coupled to the respective output CK signals are the normal working voltage of the PWM IC 50. The voltage value of VGH has not dropped, and thus is higher than the activation voltage of the TFT in prior art. Thus, the TFT can be completely activated to make the liquid crystal panel capacitor start being discharged. As shown in FIG. 6, the signal diagram of the respective CK signals shows dropping along with the descend of VGH, and then the voltage value of pin b coupled to the voltage divider interface of the voltage divider circuit will definitely drop. When it drops under the deactivation voltage threshold value, the level shift IC 51 changes the respective output CK signals from the sync signals of VGH to low voltage level, and the TFT is deactivated, and the liquid crystal capacitor stops being discharged. For the second preferred embodiment of the present invention, the activation and the deactivation of the TFT is controlled by the level shift IC, thus, the period of the Discharge function is controllable. The period of the Discharge function can be adjusted for satisfying the loading requirement for the GOA panels of various sizes. Besides, the low voltage level outputted by the respective output CK signals of the level shift IC 51 can effectively reduce the power consumption of the liquid crystal panel and the TFT polarization. Compared with the first preferred embodiment of the present invention, the respective output CK signals are synchronized with VGH. Therefore, as VGH has not reached zero, the respective output CK signals are applied to the control electrode (G electrode) of the TFT. Consequently, the TFT leakage current will definitely occur and the consumption of the TFT will be increase to increase the power consumption of the liquid crystal panel. Moreover, the long term voltage application to the control electrode of the TFT will cause the TFT polarization. Because the TFT is a switch of rapid on/off, the long term activation state of the TFT will result in the TFT polarization, and the TFT polarization phenomenon occurs. The switch speed of the TFT is affected. Such condition can cause the decrease of the switch speed of the display image on the liquid crystal panel. In conclusion, the second preferred embodiment of the present invention will not have the panel display ghost but have advantages of Discharge function period adjustment and TFT polarization reduction.

Besides, the voltage divider circuit provided by the second preferred embodiment of the present invention also effectively reduces the cost of the level shift IC. For the pin a, which is a voltage monitoring pin, and the sensitivity is higher. If Vin is directly applied to pin a, then a comparison voltage which is similar to the Vin voltage value has to added in the level shift IC, and the Vin voltage value is higher, and once one higher comparison voltage is added inside the level shift IC, the cost of the level shift IC is inevitably increased. Moreover, the addition of one higher comparison voltage in the level shift IC can easily cause the condition of internal short in the level shift IC. Once the voltage divider circuit is utilize, this problem can be well solved, which does not only reduce the monitoring voltage but also reduces the sensitivity of the voltage monitoring a little. Thus, the addition of the Vin voltage divider circuit can effectively reduce the cost of the level shift IC. Similarly, the VGH voltage divider circuit also can effectively reduce the cost of the level shift IC.

Besides, the present invention further provides a display device, and the display device comprises a display panel, and the display panel comprises a panel signal control circuit, and the specific structure of the panel signal control circuit can be referred to the description of the embodiment of the aforesaid panel signal control circuit. The repeated description is omitted here.

Above are embodiments of the present invention, which does not limit the scope of the present invention. Any modifications, equivalent replacements or improvements within the spirit and principles of the embodiment described above should be covered by the protected scope of the invention.

What is claimed is:

1. A panel signal control circuit, comprising:

a pulse width modulation integrated circuit (PWM IC) and a voltage level transfer integrated circuit (level shift IC), wherein the panel signal control circuit further comprises:

a Vin voltage divider circuit, wherein one end of the Vin voltage divider circuit is coupled to an input port of an input working voltage Vin of the PWM IC, and the other end of the Vin voltage divider circuit is grounded;

wherein a voltage divider interface of the Vin voltage divider circuit is coupled to a pin a of the level shift IC, and the pin a is a voltage monitor pin, and as the voltage of the pin a is lower than an activation voltage threshold, respective output clock CK pins of the level shift IC output sync signals of an output working voltage VGH of the PWM IC;

wherein the panel signal control circuit further comprises: a VGH voltage divider circuit; one end of the VGH voltage divider circuit is coupled to a VGH output port of the PWM IC, and the VGH voltage divider circuit is grounded, and a voltage divider interface of the VGH voltage divider circuit is coupled to a pin b of the level shift IC, and the pin b is another voltage monitor pin, and as the voltage of the pin b is lower than a deactivation voltage threshold, the respective output CK pins output low voltage level signals; and wherein the VGH voltage divider circuit comprises a variable resistor, and two interfaces of the variable resistor respectively are the two ends of the VGH voltage divider circuit, and a resistance adjustment interface of the variable resistor is the voltage divider interface of the VGH voltage divider circuit.

2. The panel signal control circuit according to claim 1, wherein the Vin voltage divider circuit comprises two resistors, a resistor R1 and a resistor R2 coupled in series; wherein the other end of the resistor R1 and one end of the resistor R2 are the voltage divider interface of the Vin voltage divider circuit, and one end of the resistor R1 and the other end of the resistor R2 respectively are the two ends of the Vin voltage divider circuit.

3. The panel signal control circuit according to claim 2, wherein the panel signal control circuit further comprises the VGH voltage divider circuit; the one end of the VGH voltage divider circuit is coupled to the VGH output port of the PWMIC, and the VGH voltage divider circuit is grounded, and the voltage divider interface of the VGH voltage divider circuit is coupled to the pin b of the level shift IC, and the pin b is another voltage monitor pin, and as the voltage of the pin b is lower than the deactivation voltage threshold, the respective output CK pins output the low voltage level signals.

4. A display panel, comprising a panel signal control circuit, which comprises: a pulse width modulation integrated circuit (PWM IC) and a voltage level transfer integrated circuit (level shift IC), wherein the panel signal control circuit further comprises:

a Vin voltage divider circuit, wherein one end of the Vin voltage divider circuit is coupled to an input port of an input working voltage Vin of the PWM IC, and the other end of the Vin voltage divider circuit is grounded;

wherein a voltage divider interface of the Vin voltage divider circuit is coupled to a pin a of the level shift IC, and the pin a is a voltage monitor pin, and as the voltage of the pin a is lower than an activation voltage threshold, respective output clock CK pins of the level shift IC output sync signals of an output working voltage VGH of the PWM IC;

wherein the panel signal control circuit further comprises a VGH voltage divider circuit; one end of the VGH voltage divider circuit is coupled to a VGH output port of the PWM IC, and the VGH voltage divider circuit is grounded, and a voltage divider interface of the VGH voltage divider circuit is coupled to a pin b of the level shift IC, and the pin b is another voltage monitor pin, and as the voltage of the pin b is lower than a deactivation voltage threshold, the respective output CK pins output low voltage level signals; and wherein the VGH voltage divider circuit comprises: a variable resistor, and two interfaces of the variable resistor respectively are the two ends of the VGH voltage divider circuit, and a resistance adjustment interface of the variable resistor is the voltage divider interface of the VGH voltage divider circuit.

5. The display panel according to claim 4, wherein the Vin voltage divider circuit comprises two resistors, a resistor R1 and a resistor R2 coupled in series; wherein the other end of the resistor R1 and one end of the resistor R2 are the voltage divider interface of the Vin voltage divider circuit, and one end of the resistor R1 and the other end of the resistor R2 respectively are the two ends of the Vin voltage divider circuit.

6. The display panel according to claim 5, wherein the panel signal control circuit further comprises the VGH voltage divider circuit; the one end of the VGH voltage divider circuit is coupled to the VGH output port of the PWM IC, and the VGH voltage divider circuit is grounded, and the voltage divider interface of the VGH voltage divider circuit is coupled to the pin b of the level shift IC, and the pin b is another voltage monitor pin, and as the voltage of the pin b is lower than the deactivation voltage threshold, the respective output CK pins output the low voltage level signals.

7. A display device, comprising a display panel, wherein the display panel comprises a panel signal control circuit, and the panel signal control circuit comprises:

a pulse width modulation integrated circuit (PWM IC) and a voltage level transfer integrated circuit (level shift IC), wherein the panel signal control circuit further comprises:

a Vin voltage divider circuit, wherein one end of the Vin voltage divider circuit is coupled to an input port of an input working voltage Vin of the PWM IC, and the other end of the Vin voltage divider circuit is grounded;

a voltage divider interface of the Vin voltage divider circuit is coupled to a pin a of the Level shift IC, and the pin a is a voltage monitor pin, and as the voltage of the pin a is lower than an activation voltage threshold, respective output clock CK pins of the Level shift IC output sync signals of an output working voltage VGH of the PWM IC;

wherein the panel signal control circuit further comprises a VGH voltage divider circuit; one end of the VGH voltage divider circuit is coupled to a VGH output port of the PWM IC, and the VGH voltage divider circuit is grounded, and a voltage divider interface of the VGH voltage divider circuit is coupled to a pin b of the level shift IC, and the pin b is another voltage monitor pin, and as the voltage of the pin b is lower than a deactivation voltage threshold, the respective output CK pins output low voltage level signals; and wherein the VGH voltage divider circuit comprises: a variable resistor, and two interfaces of the variable resistor respectively are the two ends of the VGH voltage divider circuit, and a resistance adjustment interface of the variable resistor is the voltage divider interface of the VGH voltage divider circuit.

8. The display device according to claim 7, wherein the Vin voltage divider circuit comprises two resistors, a resistor R1 and a resistor R2 coupled in series; wherein the other end of the resistor R1 and one end of the resistor R2 are the voltage divider interface of the Vin voltage divider circuit, and one end of the resistor R1 and the other end of the resistor R2 respectively are the two ends of the Vin voltage divider circuit.

9. The display device according to claim 8, wherein the panel signal control circuit further comprises the VGH voltage divider circuit; the one end of the VGH voltage divider circuit is coupled to the VGH output port of the PWMIC, and the VGH voltage divider circuit is grounded, and the voltage divider interface of the VGH voltage divider circuit is coupled to the pin b of the level shift IC, and the pin b is another voltage monitor pin, and as the voltage of the pin b is lower than the deactivation voltage threshold, the respective output CK pins output the low voltage level signals.

* * * * *